US011639249B2

(12) United States Patent
Yamada

(10) Patent No.: US 11,639,249 B2
(45) Date of Patent: May 2, 2023

(54) TUBE CONTAINER HOLDER

(71) Applicant: SINKATEC CO., LTD., Osaka (JP)

(72) Inventor: Tsuneo Yamada, Osaka (JP)

(73) Assignee: SINKATEC CO., LTD., Osaka (JP)

( * ) Notice: Subject to any disclaimer, the term of this patent is extended or adjusted under 35 U.S.C. 154(b) by 41 days.

(21) Appl. No.: 17/313,651

(22) Filed: May 6, 2021

(65) Prior Publication Data

US 2021/0354881 A1 Nov. 18, 2021

(30) Foreign Application Priority Data

May 13, 2020 (JP) ..... JP2020-084549

(51) Int. Cl.
*B65D 35/24* (2006.01)

(52) U.S. Cl.
CPC ..... *B65D 35/245* (2013.01)

(58) Field of Classification Search
CPC ..... B65D 35/245; B65D 23/003
See application file for complete search history.

(56) References Cited

U.S. PATENT DOCUMENTS 3,190,500 A * 6/1965 Miles ..... B65D 35/245 222/105
3,297,288 A * 1/1967 Cardoza ..... B65D 35/565 248/316.4
3,862,706 A * 1/1975 Burkart ..... A47K 1/09 222/105
4,500,061 A * 2/1985 Nigro ..... B65D 35/245 222/105
5,553,819 A 9/1996 Smajdek

FOREIGN PATENT DOCUMENTS

JP H01108275 U1 4/1989
JP 11321874 A * 11/1999
JP 2000238809 A * 9/2000
JP 2000238809 A 9/2000
JP 2003170948 A 6/2003
JP 2015009825 A 1/2015

* cited by examiner

*Primary Examiner* — Donnell A Long
(74) *Attorney, Agent, or Firm* — SZDC Law P.C.

(57) ABSTRACT

A tube container holder that can support a tube container in an orientation in which a discharge port thereof is located downward. The tube container holder includes an attaching portion that is configured to attach the tube container holder to an attachment-target object and a sandwiching portion having a groove portion that is configured such that a sealing portion of a tube container is insertable thereinto and sandwiched.

4 Claims, 7 Drawing Sheets

TUBE CONTAINER HOLDER

This application claims priority to Japanese Patent Application No. 2020-084549, filed on May 13, 2020, which is incorporated by reference for all purposes as if fully set forth herein.

BACKGROUND OF THE INVENTION

Field of the Invention

The present invention relates to a tube container holder from which a tube container can be suspended.

Description of the Related Art

Tube containers are widely used as containers for fluid products such as cosmetics such as face wash and shampoo, seasonings such as mayonnaise and ketchup, and building materials such as sealants and adhesives. In a tube container having a typical structure, one end of a tubular body that is made of a thermoplastic resin such as polyethylene is sealed, a discharge port is provided at the other end, and a removable lid is attached to the discharge port. In a case where a product filled in such a tube container is used, when the amount of the content of the tube container is reduced, the product may adhere to the inner surface of a portion away from the discharge port of the tube container, and it may be difficult to discharge the product from the container.

In view of such a problem, a technique for supporting the tube container in an orientation in which the discharge port thereof is located downward is disclosed. This is because, if the tube container is stored in an orientation in which the discharge port thereof is located downward, the content of the tube container moves toward the discharge port under its own weight, and the content can easily be discharged. For example, JP 2015-9825A (Patent Document 1) discloses an inverting stand instrument that can support a tube container in an orientation in which the discharge port is located downward. This instrument receives the lid of the tube container in a space formed with a plurality of flexible ribs, and therefore the instrument can be attached to a tube container regardless of the size of the tube container (lid). Also, JP 2003-170948A (Patent Document 2) discloses a tube container that is provided with a through hole at one end that is sealed. With this tube container, the through hole can be locked to a hook or the like that is provided on a wall surface so that the tube container can be supported in an orientation in which the discharge port is located downward.

PRIOR ART DOCUMENTS

Patent Documents

Patent Document 1: JP 2015-9825A
Patent Document 2: JP 2003-170948A
Patent Document 3: Microfilm of Japanese Utility Model Application No. S63-3555 (JP 01-108275U1)

SUMMARY OF THE INVENTION

Problems to be Solved by the Invention

However, with the technique according to Patent Document 1, the inverting stand instrument may come loose from the lid when the lid is attached to or detached from the inverting stand instrument, and it may be necessary to reattach the inverting stand instrument to the lid. Also, with the technique according to Patent Document 2, it is necessary to provide a through hole during the manufacturing stage of the tube container, and the technique cannot be applied to a tube container without a through hole.

Therefore, there is demand for realizing a tube container holder that can support a tube container in an orientation in which the discharge port thereof is located downward, in a highly versatile manner while reducing the number of times the tube container holder is attached to or detached from the tube container.

Means for Solving Problems

The tube container holder according to the present invention is a tube container holder from which a tube container that has a sealing portion provided at one end thereof and a discharge port portion provided at the other end thereof can be suspended such that the discharge port portion is located downward, the tube container holder comprising: an attaching portion configured to attach the tube container holder to an attachment-target object; and a sandwiching portion having a groove portion that is configured such that the sealing portion is insertable thereinto, and configured to sandwich the sealing portion when the sealing portion is inserted into the groove portion, wherein the sandwiching portion includes a first wall portion, a second wall portion, and a partition portion that define the groove portion, the first wall portion and the second wall portion extend in a first direction that is parallel with a width direction of the sealing portion when the sealing portion is sandwiched, and the partition portion: extends from the first wall portion or the second wall portion in a direction that is opposite a direction in which the tube container is suspended; and extends in the first direction in a space defined by the first wall portion and the second wall portion.

A tube container holder with such a configuration can be attached to a sealing portion side of a tube container, and therefore the tube container holder, when attached, does not prevent the content from being discharged. Therefore, it is unnecessary to remove the tube container holder from the tube container except when the tube container is empty and the tube container is to be replaced. Also, the tube container holder is configured to be able to sandwich the sealing portion of the tube container, and therefore the tube container holder can be applied to various tube containers without applying any special processing to the tube container in advance.

The following describes preferred embodiments of the present invention. However, the scope of the present invention is not limited by the preferred embodiments described below.

It is preferable that, in the tube container holder according to the present invention, a separation distance between the partition portion and whichever of the first wall portion or the second wall portion that is not continuous with the partition portion gradually decreases from one end side of the groove portion in the first direction to the other end side.

In the tube container holder with this configuration, the groove portion is provided with a wide portion into which the sealing portion of the tube container can easily be inserted, and a narrow portion that is likely to reliably sandwich the sealing portion. Therefore, it is possible to realize a tube container holder that can easily be attached and is also less likely to be detached.

In one aspect of the tube container holder according to the present invention, it is preferable that at least the first wall portion or the second wall portion has a cutout portion in one end portion thereof in the first direction.

In the tube container holder with this configuration, the cutout portion can guide the sealing portion of the tube container while folding it. Therefore, it is easy to attach the tube container holder to the tube container.

Further features and advantages of the present invention will be further clarified by the following illustration of exemplary and non-limiting embodiments described with reference to the drawings.

DESCRIPTION OF EMBODIMENTS

An embodiment of a tube container holder according to the present invention will be described with reference to the drawings. The following describes an example in which the tube container holder according to the present invention is applied to a tube container holder 1 for suspending a tube container 4 filled with cosmetics such as face wash by attaching it to a base member B (example of an attachment-target object).

Usage State

Figure 8:
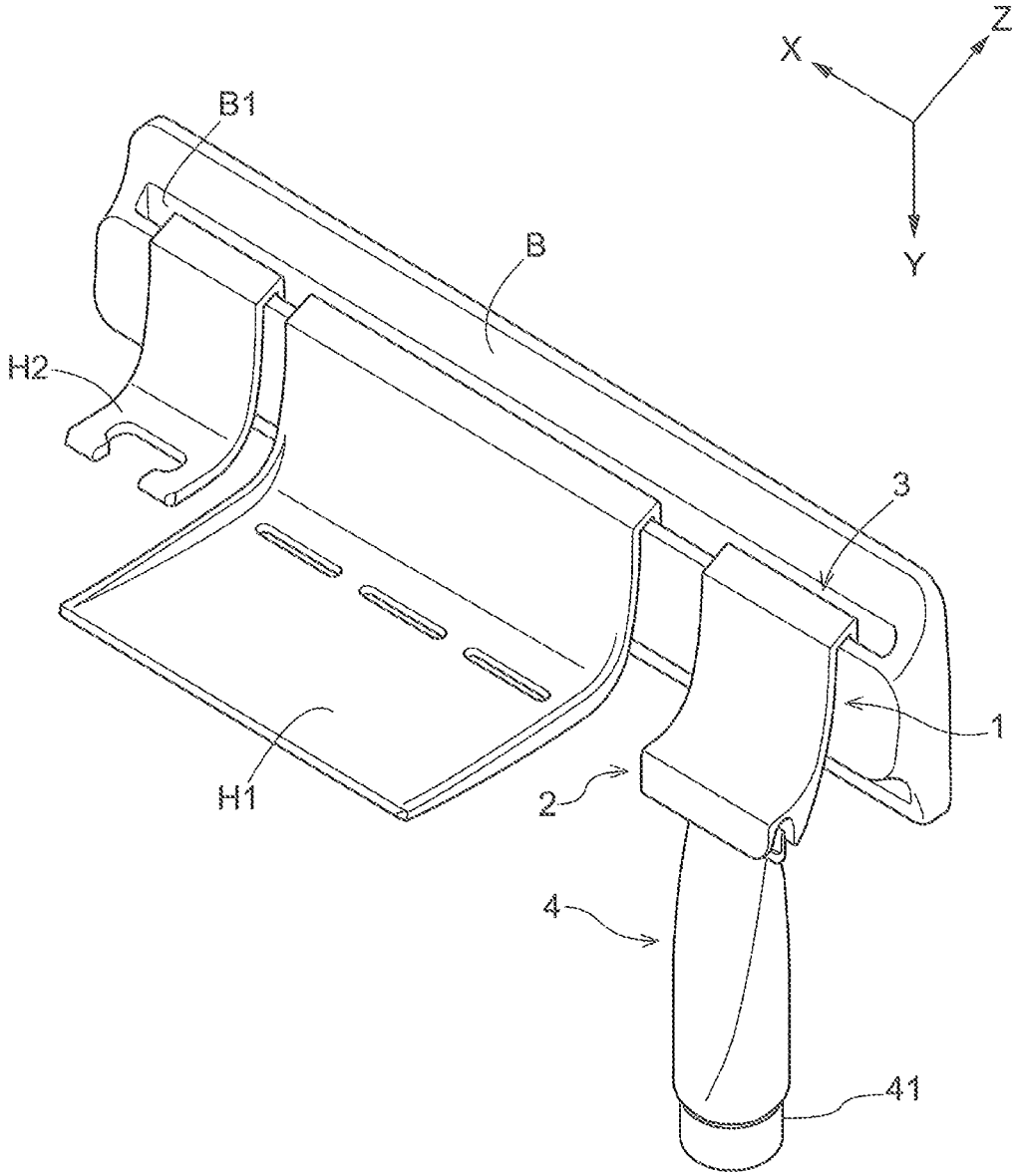
FIG. 8 is a perspective view showing a usage state of the tube container holder according to the embodiment.
Figure 9:
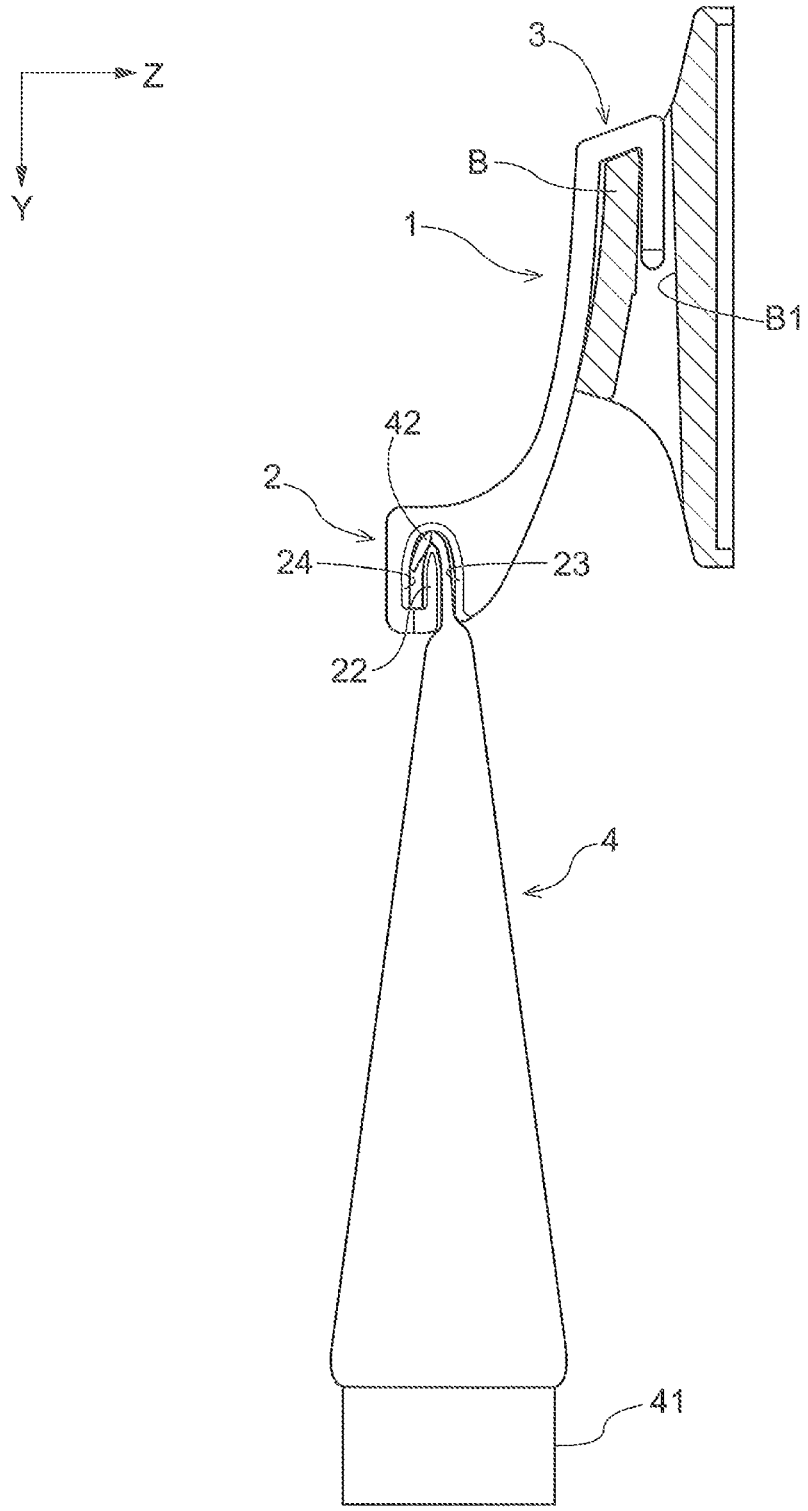
FIG. 9 is a left side view showing a usage state of the tube container holder according to the embodiment.

Before describing a specific configuration of the tube container holder 1 according to the present embodiment, the following describes a usage state thereof. FIGS. 8 and 9 show a state in which the tube container holder 1 is used so that the tube container 4 is attached to and suspended from the base member B. The tube container 4 is formed of a tubular body made of a thermoplastic resin such as polyethylene. A sealing portion 42 that is formed by thermally fusing a thermoplastic resin is provided to seal one end portion thereof and a discharge port portion from which the contents of the container (in this embodiment, cosmetics such as face wash) can be discharged is provided at the other end portion. Note that FIG. 8 shows a state in which a cap 41 is attached to the discharge port portion.

Configuration of Tube Container Holder

As shown in FIGS. 1 to 7, the tube container holder 1 according to the present embodiment is a member curved into a bow shape, and is provided with a sandwiching portion 2 at one end thereof and an attaching portion 3 at the other end thereof. The sandwiching portion 2 can sandwich the sealing portion 42 of the tube container 4, and the attaching portion 3 can attach the tube container holder 1 to the base member B. The tube container holder 1 is integrally molded using a thermoplastic resin such as polypropylene or ABS.

Figure 1:
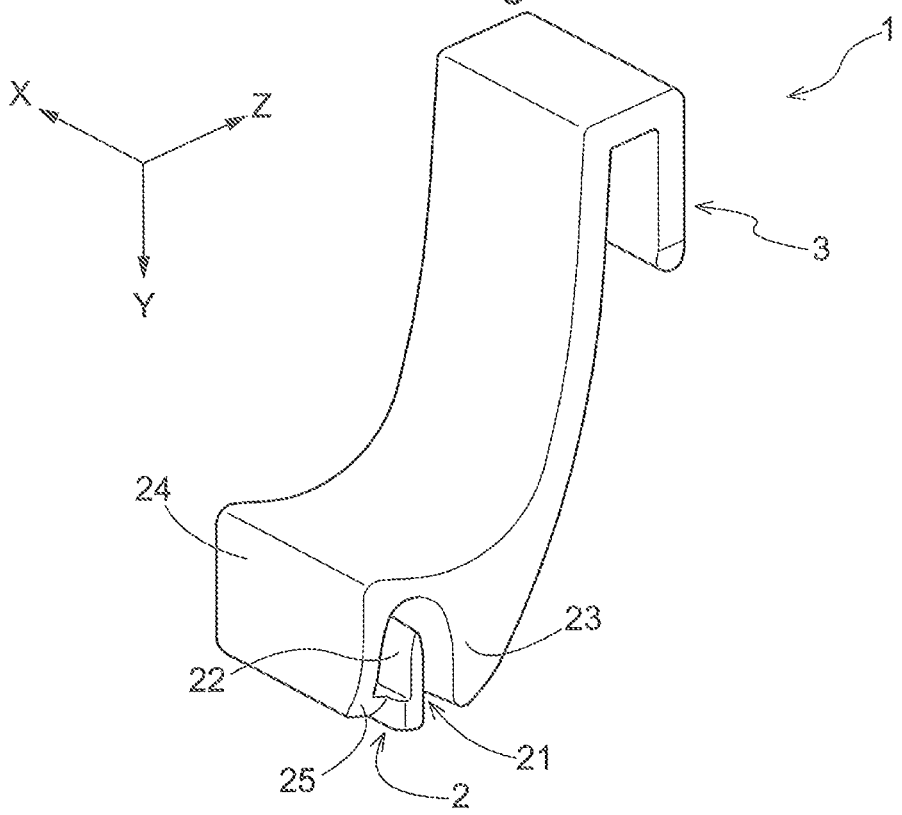
FIG. 1 is a perspective view of a tube container holder according to an embodiment.

The sandwiching portion 2 is provided with a groove portion 21 into which the sealing portion 42 of the tube container 4 can be inserted. As a result of the sealing portion 42 being inserted into the groove portion 21, the sealing portion 42 is sandwiched and fixed by the sandwiching portion 2. As shown in FIG. 1, the groove portion 21 extends in a first direction X. Here, the first direction X is a direction that is parallel with the width direction of the sealing portion 42 when the sealing portion 42 is sandwiched.

Figure 2:
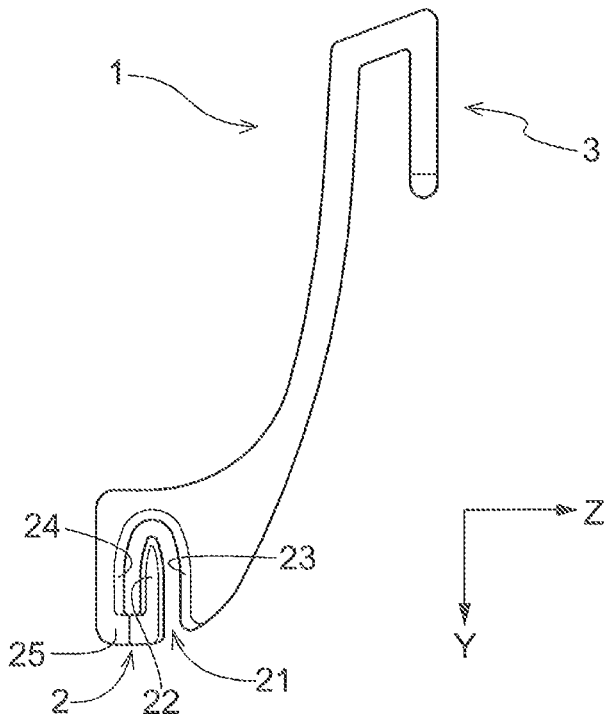
FIG. 2 is a left side view of the tube container holder according to the embodiment.
Figure 3:
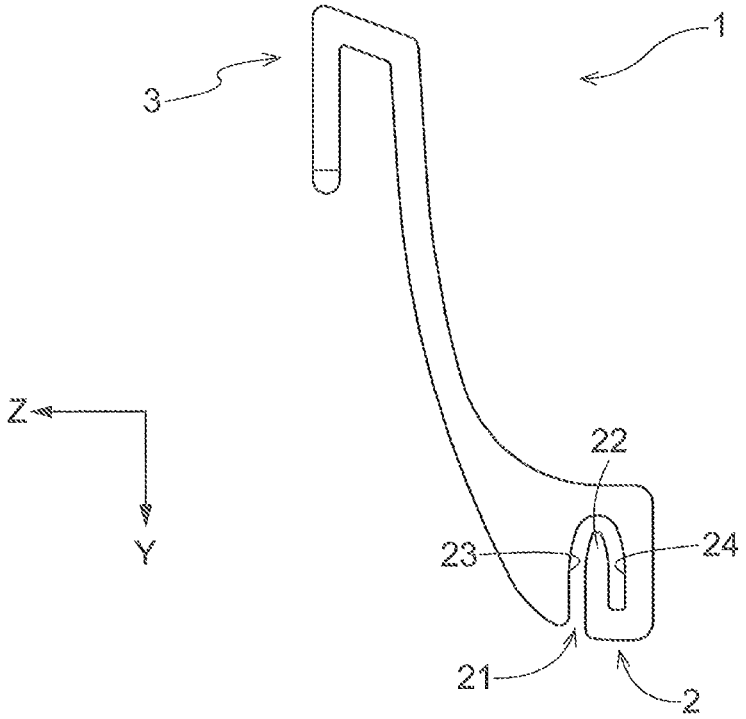
FIG. 3 is a right side view of the tube container holder according to the embodiment.

As shown in FIGS. 2 and 3, the groove portion 21 is defined by a first wall portion 23, a second wall portion 24, and a partition portion 22 that is continuous with the second wall portion 24. The first wall portion 23, the second wall portion 24, and the partition portion 22 all extend in the first direction X. The partition portion 22 of these portions is provided between the first wall portion 23 and the second wall portion 24. More specifically, the partition portion 22 extends from the second wall portion 24 in the direction opposite the direction in which the tube container 4 is suspended when used. Therefore, it can be said that the shape of the groove portion 21 is a shape formed by partitioning a space whose outer edge is defined by the first wall portion 23 and the second wall portion 24, using the partition portion 22. The portion of the groove portion 21 defined by the first wall portion 23 and the partition portion 22 is open in a second direction Y, and the portion of the same defined by the second wall portion 24 and the partition portion 22 is closed in the second direction Y. Note that the second direction Y is the direction in which the tube container 4 is suspended when the sealing portion 42 is sandwiched by the sandwiching portion 2 (FIG. 8).

Figure 4:
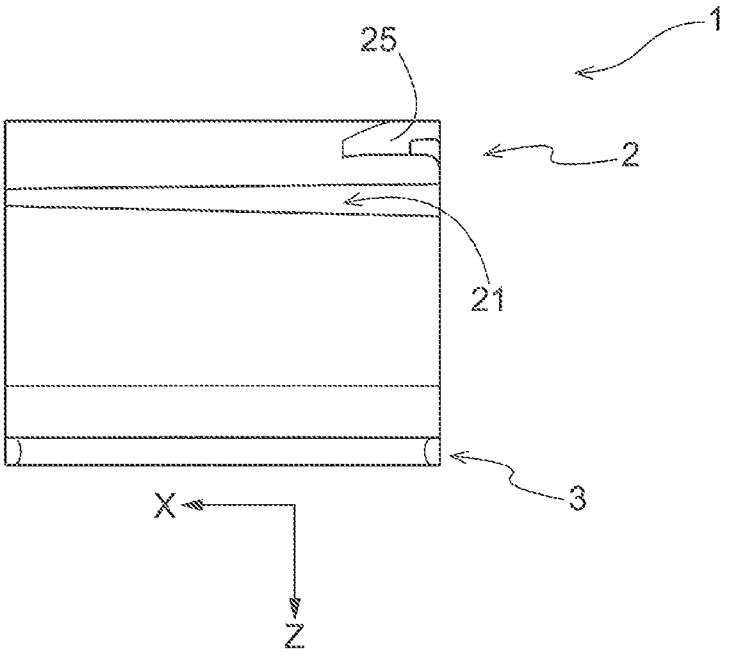
FIG. 4 is a bottom view of the tube container holder according to the embodiment.
Figure 5:
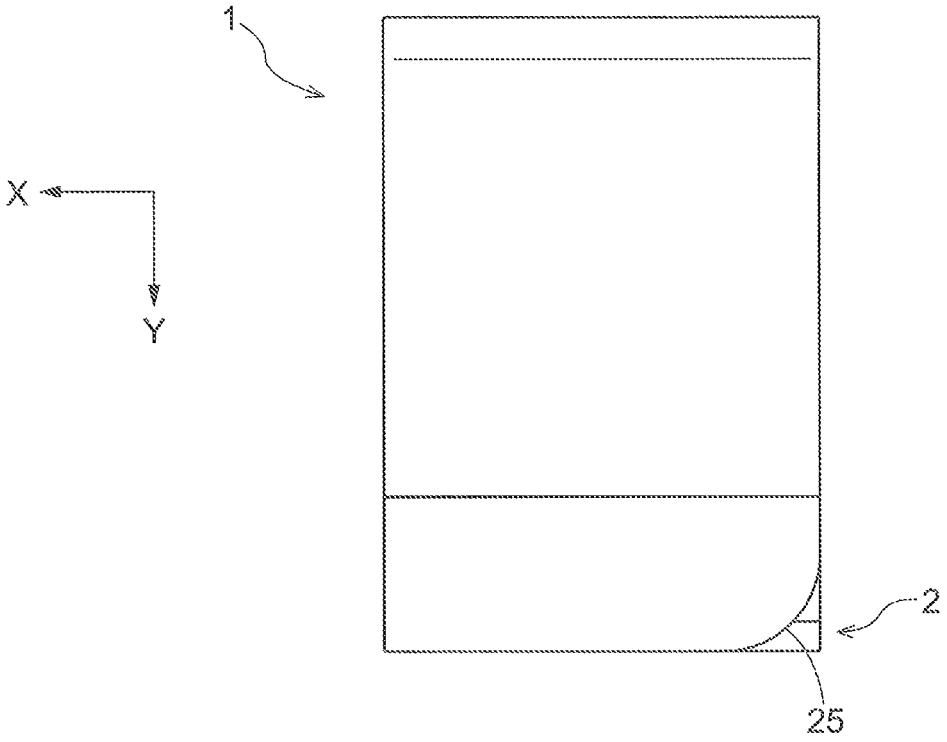
FIG. 5 is a front view of the tube container holder according to the embodiment.
Figure 6:
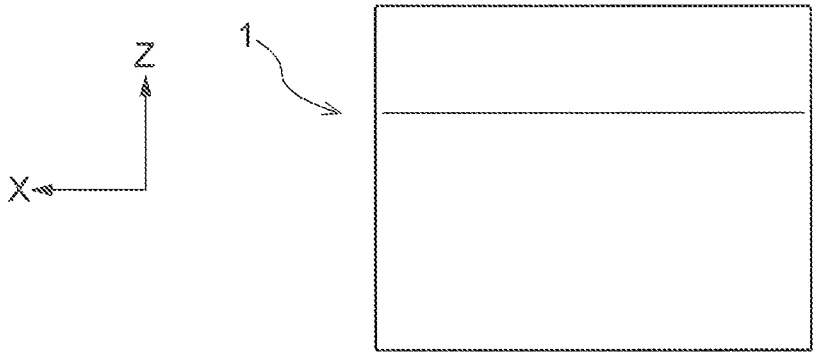
FIG. 6 is a top view of the tube container holder according to the embodiment.
Figure 7:
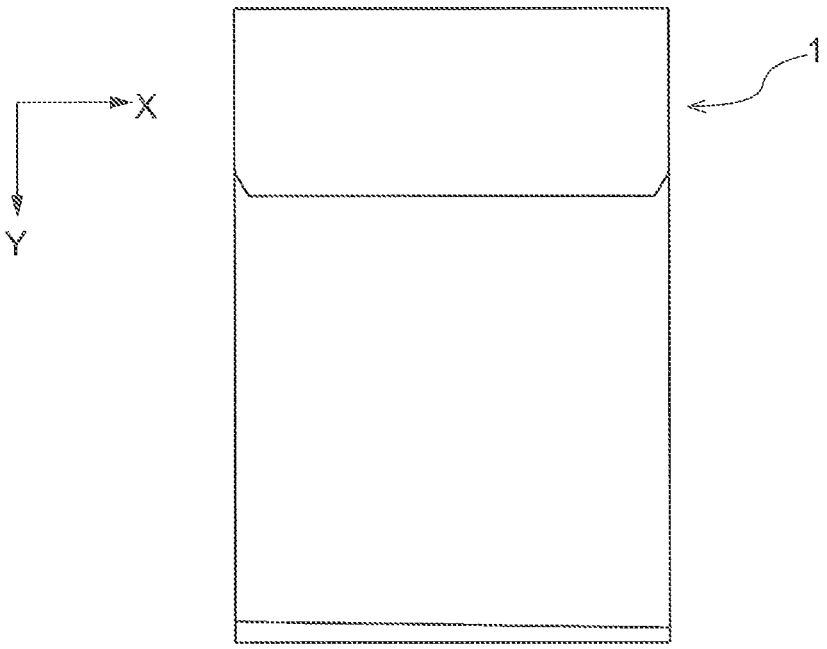
FIG. 7 is a rear view of the tube container holder according to the embodiment.

As shown in FIGS. 2 to 4, the groove portion 21 is configured such that both the separation distance between the first wall portion 23 and the partition portion 22 and the separation distance between the second wall portion 24 and the partition portion 22 gradually decrease from one end side (the left side (FIG. 2)) to the other end side (the right side (FIG. 3)) in the first direction X. Also, as shown in FIG. 5, a cutout portion 25 is provided in the outer edge on one end side (the left side (FIG. 2)) of the second wall portion 24.

The attaching portion 3 is formed in a hook shape, and can attach the tube container holder 1 to an attachment-target object such as the base member B. As shown in FIGS. 1 to 3, the attaching portion 3 is provided on the opposite side to the side toward which the tube container holder 1 formed in a bow shape is warped.

Method for Using Tube Container Holder

As shown in FIGS. 8 and 9 in the usage state of the tube container holder 1 according to the present embodiment, the sealing portion 42 of the tube container 4 is sandwiched by the sandwiching portion 2 provided at one end portion of the tube container holder 1. The attaching portion 3 in a hook shape provided at the other end portion of the tube container holder 1 is hooked to the base member B, and thus the tube container holder 1 is attached to the base member B. At this time, the tube container 4 is suspended such that the discharge port portion (the cap 41 in FIG. 8) is located downward.

Note that the base member B is a member that can be fixed to a wall surface or the like, and is provided with a groove B1 to which the attaching portion 3 formed in a hook shape can be hooked. FIG. 8 shows an example in which a tray H1 and a shaver holder H2 are attached to the base member B, in addition to the tube container holder 1. Attaching portions that have the same shape as the attaching portion 3 of the tube container holder 1 are respectively attached to the tray H1 and the shaver holder H2. In this way, by combining a plurality of members that have attaching portions formed into the same shape, and are provided with supporting portions (the sandwiching portion 2 in the case of the tube container holder 1) that have different shapes and can support different target objects, it is possible to form supporting members that can support any target object desired by the user.

When the sealing portion 42 of the tube container 4 is to be sandwiched by the sandwiching portion 2 of the tube container holder 1, the sealing portion 42 is inserted into the groove portion 21. At this time, the width on the left side (FIG. 2) of the groove portion 21 in a third direction Z is formed so as to be larger than that of the right side (FIG. 3). Therefore, it is easier to insert the sealing portion 42 from the left side of the groove portion 21.

At this time, the sealing portion 42 is bent in advance and inserted into the groove portion 21 so that the sealing portion 42 extends along the first wall portion 23 and the second wall portion 24. As a result of this operation, the sealing portion 42 is sandwiched in the state of being displaced toward the left side of the groove portion 21. That is to say, a portion of the sealing portion 42 is sandwiched by the sandwiching portion 2, and the rest thereof is not sandwiched by the sandwiching portion 2. Also, the portion of the sealing portion 42 sandwiched by the sandwiching portion 2 is folded back along the first wall portion 23 and the second wall portion 24, and the portion not sandwiched by the sandwiching portion 2 is not folded back.

Finally, the sealing portion 42 (the tube container 4) sandwiched in the state of being displaced toward the left side of the groove portion 21 is moved toward the right side of the groove portion 21. At this time, the sealing portion 42 is moved toward the portion of the groove portion 21 with a small width, and as a result, the sealing portion 42 is firmly sandwiched by the sandwiching portion 2. Through the above-described operations, the sealing portion 42 (the tube container 4) is completely sandwiched. Here, the entire sealing portion 42 is folded back along the first wall portion 23 and the second wall portion 24. Therefore, it is possible to desirably prevent the sealing portion 42 from falling out of the sandwiching portion 2.

Note that when the sealing portion 42 is moved toward the right side of the groove portion 21, the cutout portion 25 provided in the outer edge on the left side of the second wall portion 24 achieves the effect of guiding the sealing portion 42, which is moved toward the right side of the groove portion 21, while folding it, as with a "three-roll presser" used in sewing machines (for example, see the microfilm of Japanese Utility Model Application No. S63-3555 (JP 01-108275U1) (Patent Document 3)).

When the sealing portion 42 of the tube container 4 is inserted into the groove portion 21, the sealing portion 42 is housed on the second wall portion 24-side of the groove portion 21, and the portion of the tube container 4 continuous with the sealing portion 42 is housed on the first wall portion 23-side of the groove portion 21. As a result, the sealing portion 42 is guided by the second wall portion 24 and the partition portion 22, and the portion of the tube container 4 continuous with the sealing portion 42 is guided by the first wall portion 23 and the partition portion 22, separately. This is because the partition portion 22 extends in the direction opposite the direction in which the tube container 4 is suspended when used.

Also, the folded portion of the tube container 4 abuts against the upper end of the partition portion 22. In the state where the tube container 4 is inserted into the groove portion 21 in this orientation, even if a load is applied downward to the tube container 4, the tube container 4 is prevented from falling out of the groove portion 21 because the folded portion of the tube container 4 abuts against the partition portion 22.

The attaching portion 3 of the tube container holder 1 in which the sealing portion 42 is sandwiched by the sandwiching portion 2 is hooked to the base member B, and thus the tube container holder 1 is hooked to the base member B. At this time, due to the weight of the tube container 4, the tube container 4 is orientated so as to be suspended (FIG. 8). That is to say, the tube container 4 is held in a suspended orientation in which the sealing portion 42 is located upward and the discharge port portion (the cap 41) is located downward.

When the content of the tube container 4 is to be used, first, the cap 41 is removed from the tube container 4 suspended from the base member B. Upon the tube container 4 being pressed, the content is discharged from the discharge port portion. At this time, the tube container 4 is in a suspended orientation in which the discharge port portion is located downward, and therefore the content is unevenly distributed on the discharge port portion side in the tube container 4. As a result, it is possible to smoothly discharge the content. Also, as is clear from the above-described procedures, it is possible to discharge the content without removing the tube container 4 from the base member B.

However, it is possible to perform the operation to discharge the content after removing the tube container 4 from the base member B. In such a case, it is only necessary to perform the operation to discharge the content with the tube container holder 1 being attached to the tube container 4, and it is unnecessary to release the state in which the tube container holder 1 sandwiches the tube container 4. The tube container 4 need only be suspended from the base member B upon the content being discharged.

Other Embodiments

Finally, other embodiments of the tube container holder according to the present invention will be described. Note that the configurations disclosed in the following embodiments may be applied in combination with the configurations disclosed in another embodiment as long as no contradiction arises.

The above embodiment describes, as an example, a configuration in which the width of the groove portion 21 in the third direction Z gradually decreases from one end side to the other end side in the first direction X. However, the present invention is not limited to such a configuration, and the width of the groove portion in the third direction may be uniform from one end side to the other end side in the first direction. Also, the width of a portion of the groove portion (for example, only the separation distance between the partition portion and whichever of the first wall portion or the second wall portion that is not continuous with the partition portion) may be configured to gradually decrease from one end side to the other end side in the first direction.

The above embodiment describes, as an example, a configuration in which the cutout portion 25 is provided in the outer edge on one end side of the second wall portion 24. However, the present invention is not limited to such a configuration, and the cutout portion may be provided in the first wall portion, or may be omitted. Note that, if a cutout portion is provided in a mode in which the width of at least a portion of the groove portion gradually decreases, it is preferable that the cutout portion is provided on one end side of the groove portion where the width thereof is large.

Figure 10:
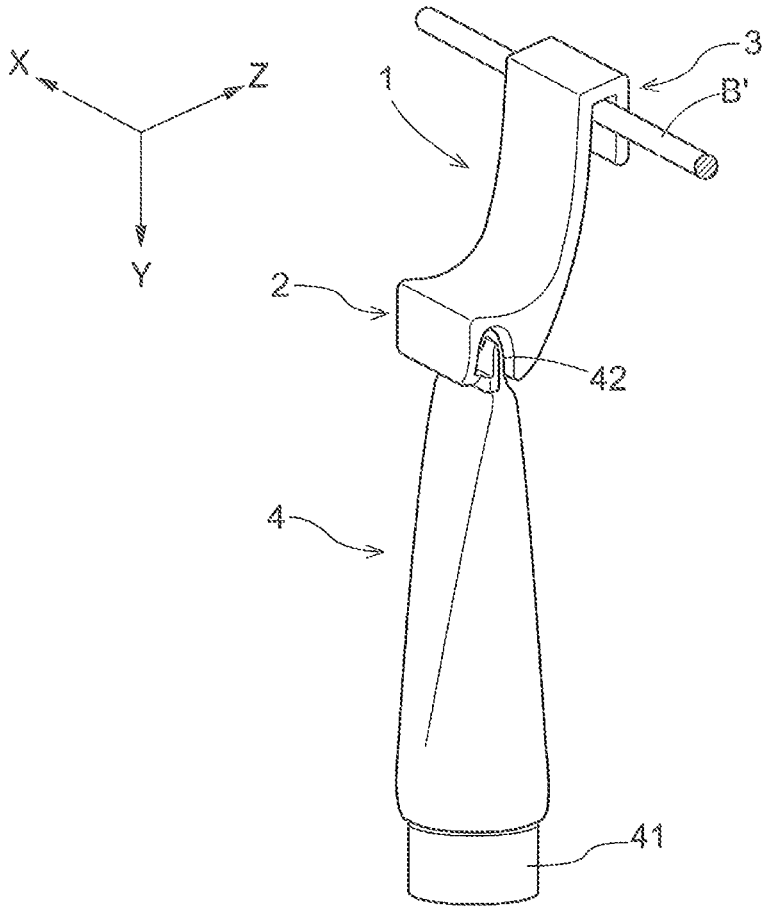
FIG. 10 is a perspective view showing a usage state of a tube container holder according to another embodiment.

The above embodiment describes, as an example, a configuration in which the attaching portion 3 is formed in a hook shape, and can attach the tube container holder 1 to an attachment-target object such as the base member B. However, the configuration of the attaching portion 3 is not specifically limited as long as it can attach the tube container holder to the attachment-target object, and may be freely selected according to the mode of the attachment-target object. For example, FIG. 10 shows an example in which the attachment-target object is a rod-shaped member B' (for example, a towel hanger), and the tube container holder 1 in the above-described embodiment is also attachable to the rod-shaped member B'. Also, if the attachment-target object is a magnet board, the attaching portion may be a magnet.

The size of the tube container holder according to the present invention is not specifically limited, and may be freely selected according to the size of the tube container that is to be sandwiched. Specifically, if the width of the tube container holder in the first direction is substantially the same as, or smaller than, the width of the sealing portion of the tube container, the tube container holder is less likely to be an obstacle when the content of the tube container is discharged.

The material used to form the tube container holder according to the present invention is not specifically limited as long as it is elastic enough to sandwich the tube container. For example, the tube container holder according to the present invention may be made of a thermoplastic resin. In addition to polypropylene and ABS described in the above embodiment, polyethylene, polystyrene, polyester, polyamide, polyvinyl chloride, silicone resin, or the like may be used. In addition, synthetic rubber such as styrene-butadiene rubber, nitrile rubber, or silicone rubber, or a metal material such as stainless steel may also be used. When the tube container holder according to the present invention is used at the same time as other members such as the tray H1 and the shaver holder H2 according to the above embodiment, if the material of the tube container holder is the same as that of the other members, it is possible to achieve a design effect that has a uniform texture.

It should be understood that, regarding other configurations, the embodiments disclosed herein are exemplary in all respects and the scope of the invention is not limited thereto. Those skilled in the art will be able to easily understand that modifications can be made as appropriate without departing from the spirit of the present invention. Therefore, other embodiments modified without departing from the spirit of the present invention are naturally included in the scope of the present invention.

INDUSTRIAL APPLICABILITY

The present invention can be applied to tube containers for various products e.g., cosmetics such as facial cleanser and shampoo, seasonings such as mayonnaise and ketchup, and building materials such as sealants and adhesives, and can be used to attach such a tube container to a support member so as to be suspended therefrom.

DESCRIPTION OF REFERENCE SIGNS

1: Tube Container Holder
2: Sandwiching Portion
21: Groove Portion
22: Partition Wall Portion
23: First Wall Portion
24: Second Wall Portion
25: Cutout Portion
3: Attaching Portion
4: Tube Container
41: Cap
42: Sealing Portion
B: Base Member
X: First Direction
Y: Second Direction
Z: Third Direction

The invention claimed is:

1. A tube container holder from which a tube container that has a sealing portion provided at one end thereof and a discharge port portion provided at the other end thereof can be suspended such that the discharge port portion is located downward, the tube container holder comprising:

an attaching portion configured to attach the tube container holder to an attachment-target object; and a sandwiching portion having a groove portion that is configured such that the sealing portion is insertable thereinto, and configured to sandwich the sealing portion when the sealing portion is inserted into the groove portion, wherein the sandwiching portion includes a first wall portion, a second wall portion, and a partition portion that define the groove portion, the first wall portion and the second wall portion extend in a first direction that is parallel with a width direction of the sealing portion when the sealing portion is sandwiched, and the partition portion: extends from the first wall portion or the second wall portion in a direction that is opposite a direction in which the tube container is suspended; and extends in the first direction in a space defined by the first wall portion and the second wall portion.

2. The tube container holder according to claim 1, wherein a separation distance between the partition portion and whichever of the first wall portion or the second wall portion that is not continuous with the partition portion gradually decreases from one end side of the groove portion in the first direction to the other end side.

3. The tube container holder according to claim 2, wherein at least the first wall portion or the second wall portion has a cutout portion in one end portion thereof in the first direction.

4. The tube container holder according to claim 1, wherein at least the first wall portion or the second wall portion has a cutout portion in one end portion thereof in the first direction.

* * * * *